US011403976B1

(12) United States Patent
Tirado

(10) Patent No.: US 11,403,976 B1
(45) Date of Patent: Aug. 2, 2022

(54) HAT FLAG

(71) Applicant: David Robles Tirado, Belews Creek, NC (US)

(72) Inventor: David Robles Tirado, Belews Creek, NC (US)

( * ) Notice: Subject to any disclaimer, the term of this patent is extended or adjusted under 35 U.S.C. 154(b) by 164 days.

(21) Appl. No.: 16/813,895

(22) Filed: Mar. 10, 2020

(51) Int. Cl.

| | |
|---|---|
| ***G09F 21/02*** | (2006.01) |
| ***A42B 1/004*** | (2021.01) |
| ***A42B 1/24*** | (2021.01) |
| ***G09F 17/00*** | (2006.01) |

(52) U.S. Cl.
CPC ..... *G09F 21/023* (2020.05); *A42B 1/004* (2013.01); *A42B 1/24* (2013.01); *G09F 17/00* (2013.01); *G09F 21/02* (2013.01)

(58) Field of Classification Search
CPC ..... G09F 17/00; G09F 21/04; G09F 21/042; G09F 21/02; G09F 21/023; G09F 2017/0066; G09F 2017/0075; A42B 1/004; A42B 1/24; A42B 1/0406
USPC ..... 40/329, 586; 116/173; D2/866, D2/882–884, 891, 895
See application file for complete search history.

(56) References Cited

U.S. PATENT DOCUMENTS

| | | | | |
|---|---|---|---|---|
| 1,839,341 | A * | 1/1932 | Hyman | A42B 1/22 D2/891 |
| 5,088,127 | A * | 2/1992 | Thornock | A42B 1/248 40/329 |
| 5,530,970 | A | 7/1996 | Knutson | |
| 5,727,497 | A * | 3/1998 | Nichols, Jr. | G09F 17/00 116/28 R |
| 6,874,167 | B1 | 4/2005 | Leszcynski | |
| D509,046 | S * | 9/2005 | Patterson | D2/866 |
| 7,234,411 | B1 | 6/2007 | Butler | |
| 8,510,916 | B2 | 8/2013 | Kinvi | |
| 2004/0006900 | A1 | 1/2004 | Beller | |
| 2007/0022514 | A1 | 2/2007 | Paulson | |
| 2008/0295295 | A1 | 12/2008 | Rogers | |
| 2010/0287684 | A1* | 11/2010 | Peterson | A42B 1/245 2/209.13 |
| 2013/0019380 | A1* | 1/2013 | Sitt | A42B 1/24 248/205.2 |
| 2017/0055617 | A1 | 3/2017 | Girven | |
| 2018/0289094 | A1 | 10/2018 | Klipa | |
| 2020/0372843 | A1* | 11/2020 | Short | G09F 17/00 |

FOREIGN PATENT DOCUMENTS

| | | | |
|---|---|---|---|
| FR | 2760328 | | 9/1998 |
| KR | 200208060 | Y1 * | 12/2000 |

* cited by examiner

*Primary Examiner* — Muhammad Ijaz
*Assistant Examiner* — Rachel Mae Griffith
(74) *Attorney, Agent, or Firm* — Kyle A. Fletcher, Esq.

(57) ABSTRACT

The hat flag comprises a flag mount and a replaceable flag assembly. The flag mount may be coupled to a hat and may present a threaded receiver for detachably coupling the replaceable flag assembly to the top of the hat. The replaceable flag assembly may display a flag elevated above the hat via a flag support rod when the replaceable flag assembly is detachably coupled to the flag mount. The replaceable flag assembly may comprise a spring-loaded base such that the flag support rod may tilt when an external force is applied and may right itself when the external force is removed. The replaceable flag assembly may comprise a bearing such that the flag is free to swivel.

18 Claims, 4 Drawing Sheets

HAT FLAG

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of novelty apparel, more specifically, a hat flag.

SUMMARY OF INVENTION

The hat flag comprises a flag mount and a replaceable flag assembly. The flag mount may be coupled to a hat and may present a threaded receiver for detachably coupling the replaceable flag assembly to the top of the hat. The replaceable flag assembly may display a flag elevated above the hat via a flag support rod when the replaceable flag assembly is detachably coupled to the flag mount. The replaceable flag assembly may comprise a spring-loaded base such that the flag support rod may tilt when an external force is applied and may right itself when the external force is removed. The replaceable flag assembly may comprise a bearing such that the flag is free to swivel.

An object of the invention is to display a miniature flag on the top of a hat or cap.

Another object of the invention is to provide a flag mount that couples to the hat or cap.

A further object of the invention is to provide a replaceable flag assembly that may detachably couple to the flag mount.

Yet another object of the invention is to provide a spring-load base with a bearing to allow for movement of the flag.

These together with additional objects, features and advantages of the hat flag will be readily apparent to those of ordinary skill in the art upon reading the following detailed description of the presently preferred, but nonetheless illustrative, embodiments when taken in conjunction with the accompanying drawings.

In this respect, before explaining the current embodiments of the hat flag in detail, it is to be understood that the hat flag is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hat flag.

It is therefore important that the claims be regarded as including such equivalent construction insofar as they do not depart from the spirit and scope of the hat flag. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
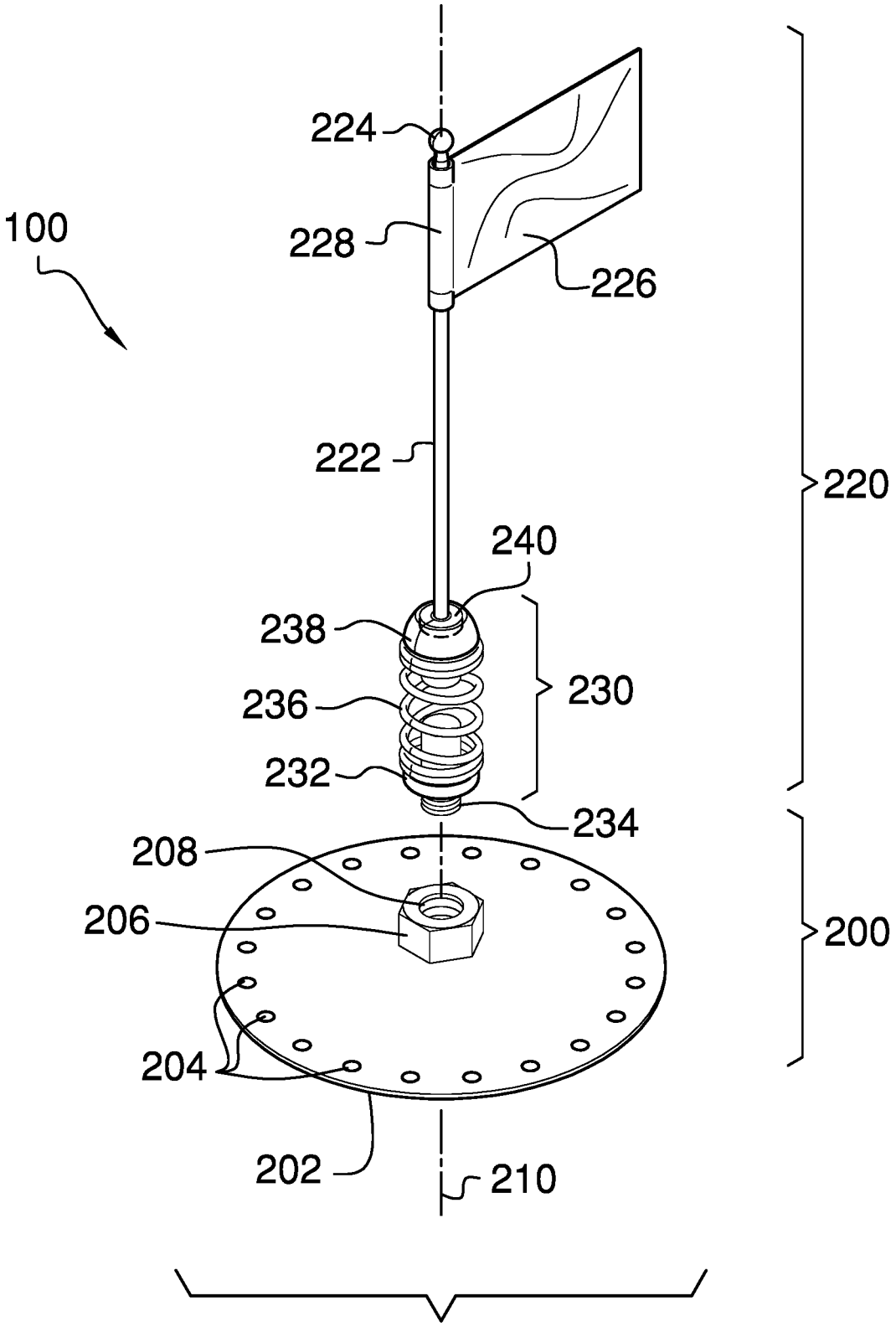
FIG. 1 is an isometric exploded view of an embodiment of the disclosure.
Figure 2:
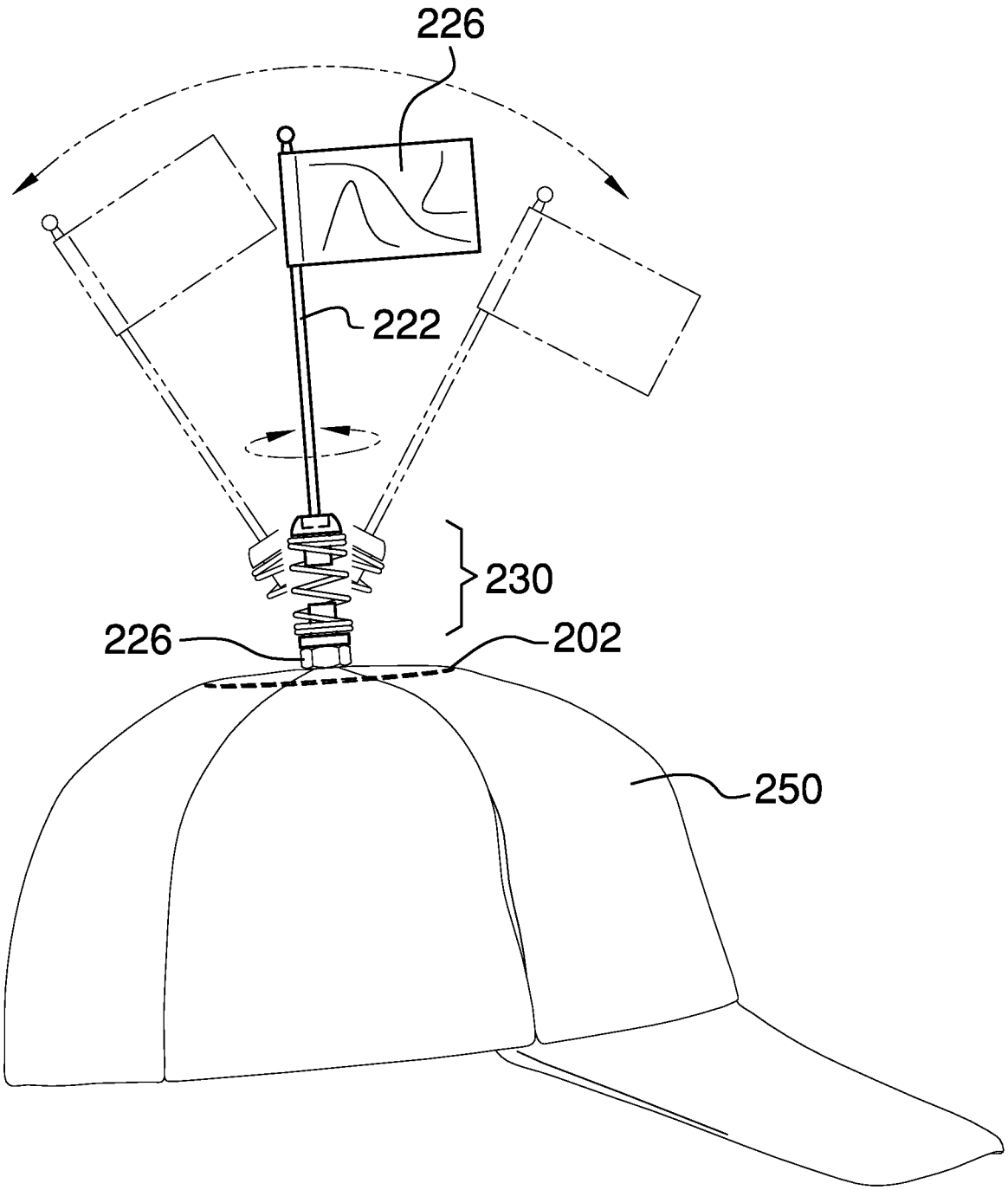
FIG. 2 is a side in-use view of an embodiment of the disclosure.
Figure 3:
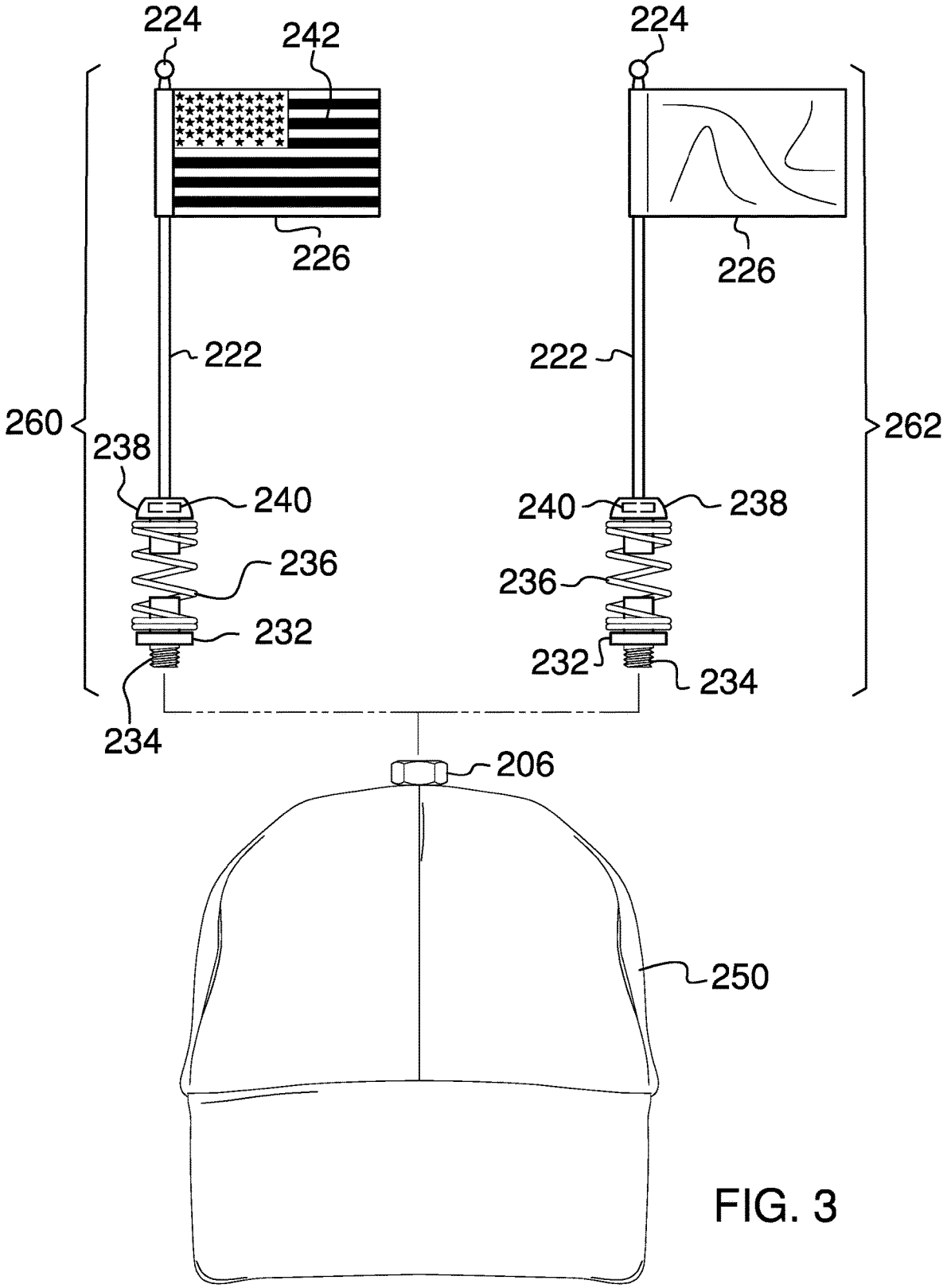
FIG. 3 is a front view of an embodiment of the disclosure illustrating multiple replaceable flag assemblies.
Figure 4:
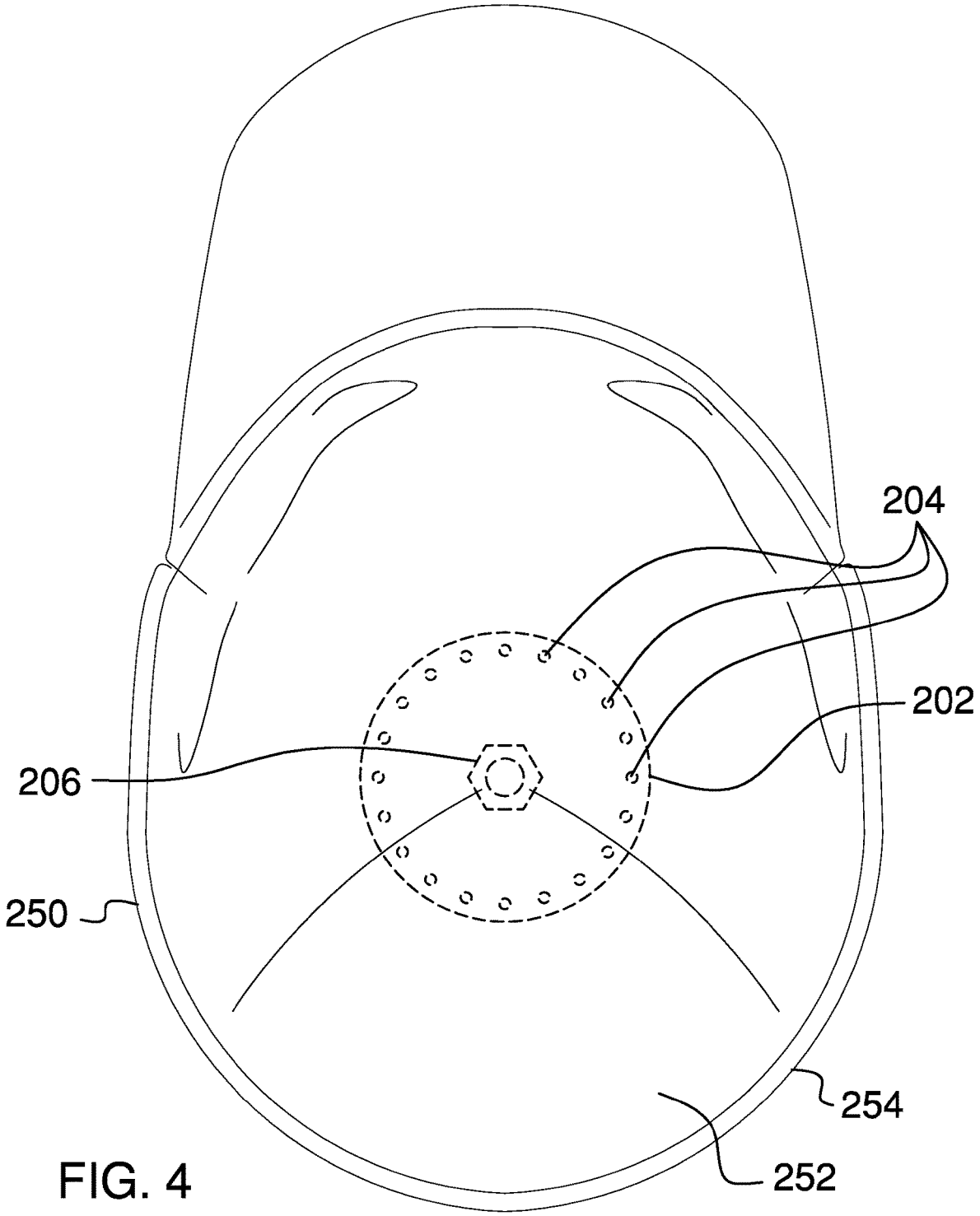
FIG. 4 is a bottom view of an embodiment of the disclosure.

Detailed reference will now be made to a first potential embodiment of the disclosure, which is illustrated in FIGS. 1 through 4.

The hat flag 100 (hereinafter invention) comprises a flag mount 200 and a replaceable flag assembly 220. The flag mount 200 may be coupled to a hat 250 and present a threaded receiver 206 for detachably coupling the replaceable flag assembly 220 to the top of the hat 250. The replaceable flag assembly 220 may display a flag 226 elevated above the hat 250 via a flag support rod 222 when the replaceable flag assembly 220 is detachably coupled to the flag mount 200.

The flag mount 200 may orient and may provide stability for the replaceable flag assembly 220. The flag mount 200 may comprise a disk 202 and the threaded receiver 206. The flag mount 200 may couple to the hat 250 such that the disk 202 is inside of the hat 250 and the threaded receiver 206 is outside of the hat 250. In some embodiments, the disk 202 may be located between an inner lining 252 of the hat 250 and an outer shell 254 of the hat 250.

The disk 202 may comprise a plurality of attachment apertures 204. The disk 202 may be a circular plate. The disk 202 may comprise the plurality of attachment apertures 204. The plurality of attachment apertures 204 may be distributed around the margin of the disk 202. The disk 202 may be retained in a fixed position within the hat 250 via the plurality of attachment apertures 204. As a non-limiting example, the disk 202 may be sewn into the hat 250 by one or more threads that lash the plurality of attachment apertures 204 to the outer shell 254 of the hat 250.

The threaded receiver 206 may be coupled to the center of the disk 202 and may protrude above the hat 250 outside of the outer shell 254. The flag mount 200 may be situated such that a central axis 210 of the threaded receiver 206 is vertically oriented. The threaded receiver 206 may comprise a receiving aperture 208. The interior sidewall of the receiving aperture 208 may be threaded for coupling to a threaded shaft 234 of the replaceable flag assembly 220.

The replaceable flag assembly 220 may comprise the flag support rod 222, the flag 226, and a flag base 230. The replaceable flag assembly 220 may be detachably coupled to the flag mount 200 to display the flag 226 above the hat 250 at the upper end of the flag support rod 222. The flag support rod 222 may be a vertically oriented shaft. The bottom of the flag support rod 222 may couple to the flag base 230. The flag 226 may couple to the top of the flag support rod 222. The flag support rod 222 may comprise a finial 224. The finial 224 may be an enlargement of the upper end of the flag support rod 222 such that the upper end of the flag support rod 222 is blunted.

The flag 226 may be a sheet of material that is supported in a vertical orientation by the flag support rod 222. As a non-limiting example, the flag 226 may be rigid or semi-rigid such that the flag 226 may be held in a position that projects horizontally away from the flag support rod 222. The flag 226 may bear an indicia 242. As non-limiting examples, the indicia 242 may comprise a national flag image, a sports team emblem, a corporate logo, alphanumeric messages, graphical icons, or combinations thereof. The flag 226 may be any shape. The most typical shapes for the flag 226 comprise square, rectangular, and triangular (also known as pennant shaped). The flag 226 may comprise a sleeve 228. The sleeve 228 may be a casing formed at one side of the flag 226 such that the flag support rod 222 pass through the sleeve 228. The flag support rod 222 may be coupled to the sleeve 228 such that the flag is held in place at the top of the flag support rod 222.

The flag base 230 may comprise a lower base 232, an upper base 238, and a spring 236. The flag base 230 may couple to the flag mount 200 to hold the flag support rod 222 in an erect orientation.

The lower base 232 may couple to the flag mount 200 via the threaded shaft 234 that projects downwards from the bottom of the lower base 232. The outside wall of the threaded shaft 234 may be threaded with a thread that complements the size and thread count of the threaded receiver 206 located on the flag mount 200.

The top of the upper base 238 may be coupled to the bottom end of the flag support rod 222. In some embodiments, the flag support rod 222 may couple to the upper base 238 via a bearing 240 such that the flag support rod 222 may swivel to redirect the flag 226.

The lower base 232 may be coupled to the upper base 238 via the spring 236. The spring 236 may allow the flag base 230 to bend such that the flag support rod 222 may be displaced from the vertical orientation by an external force and will return to the vertical orientation when the external force is removed.

The invention 100 may further comprise the hat 250. The hat 250 may be a clothing accessory that is adapted to cover the head of a user.

In use, a replaceable flag assembly 220 bearing an indica 242 that a user desires to display is selected and coupled to the top of a hat 250 by screwing a flag base 230 on the replaceable flag assembly 220 into a threaded receiver 206 on a flag mount 200 of the hat 250. The hat 250 is placed on the head of the user and a flag support rod 222 may be held vertically above the hat 250 with a flag 226 displayed at the top of the flag support rod 222. If the flag 226 encountered an obstacle, the flag support rod 222 may tilt as the flag base 230 flexes at a spring 236 of the flag base 230. The flag support rod 222 may return to the vertical and upright position when the flag 226 is clear of the obstacle. The flag support rod 222 may rotate at a bearing 240 due to the influence of wind or motion or when the user tilts their head. The user may easily remove a first replaceable flag assembly 260 and install a second replaceable flag assembly 262 to change the appearance of the hat 250.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, a "bearing" is anything that holds a rotating or sliding shaft or tube. A bearing may guide a moving component, limit the motion of a moving component relative to a fixed component and/or reduce the friction between the moving component and the fixed component.

As used herein, "casing" refers to material at the edge of a fabric which has been folded and bonded to form a hollow channel. The casing may be used to hold and/or pass elastic, cording, boning, or stiffening.

As used herein, the words "couple", "couples", "coupled" or "coupling", refer to connecting, either directly or indirectly, and does not necessarily imply a mechanical connection.

As used in this disclosure, a "disk" is a cylindrically shaped object with parallel opposing sides. A disk generally has a thickness (as measured from flat side to flat side) that is less than the radius of the cylinder.

As used herein, a "finial" is an ornamental termination for a rod, screw, staff, shank, post, peak, spire, pinnacle, or gable. A finial may be purely decorative or may be functional. As a non-limiting example, a finial may provide waterproofing or a housing for another object. Non-limiting examples of places where finials are used include curtain rods, lamp shades, walking canes, building roofs, furniture, fence posts, flag poles, and staircase newel posts.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the term "indicia" refers to a set of markings that identify a sentiment.

As used in this disclosure, the word "interior" is used as a relational term that implies that an object is located or contained within the boundary of a structure or a space.

As used in this disclosure, a "logo" is artwork that is typically associated with an organization, brand, or activity. The logo may be textual, graphical, or both.

As used in this disclosure, "orientation" refers to the positioning and/or angular alignment of a first object relative to a second object or relative to a reference position or reference direction.

As used in this disclosure, "resilient" or "semi-rigid" refer to an object or material which will deform when a force is applied to it and which will return to its original shape when the deforming force is removed.

As used herein, "rigid" refers to an object or material which is inflexible. If a force is applied to a rigid object the rigid object does not bend or deform unless the force applied reaches the breaking point of the rigid object.

As used in this disclosure, the term "shaft" is used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "sleeve" is a tube like covering that is placed over or around a rod, shaft, cable, or other cylindrical object.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hat with a flag comprising:

a flag mount and a replaceable flag assembly;

wherein the flag mount is coupled to a hat;

wherein the flag mount presents a threaded receiver for detachably coupling the replaceable flag assembly to a top of the hat;

wherein the replaceable flag assembly displays the flag elevated above the hat via a flag support rod when the replaceable flag assembly is detachably coupled to the flag mount;

wherein the flag mount comprises a disk and the threaded receiver;

wherein the disk is located between an inner lining of the hat and an outer shell of the hat;

wherein the disk comprises a plurality of attachment apertures;

wherein the plurality of attachment apertures are distributed around a margin of the disk;

wherein the disk is retained in a fixed position within the hat via the plurality of attachment apertures.

2. The hat with a flag according to claim 1 wherein the flag mount orients and provides stability for the replaceable flag assembly;

wherein the flag mount couples to the hat such that the disk is inside of the hat and the threaded receiver is outside of the hat.

3. The hat with a flag according to claim 2 wherein the disk is sewn into the hat by one or more threads that lash the plurality of attachment apertures to the outer shell of the hat.

4. The hat with a flag according to claim 3 wherein the threaded receiver is coupled to a center of the disk and protrudes above the hat outside of the outer shell;

wherein the flag mount is situated such that a central axis of the threaded receiver is vertically oriented.

5. The hat with a flag according to claim 4 wherein the threaded receiver comprises a receiving aperture;

wherein an interior sidewall of the receiving aperture is threaded for coupling to a threaded shaft of the replaceable flag assembly.

6. The hat with a flag according to claim 5 wherein the replaceable flag assembly comprises the flag support rod, the flag, and a flag base;

wherein the replaceable flag assembly is detachably coupled to the flag mount to display the flag above the hat at an upper end of the flag support rod;

wherein the flag support rod is a vertically oriented shaft.

7. The hat with a flag according to claim 6 wherein a bottom of the flag support rod couples to the flag base;

wherein the flag couples to the top of the flag support rod.

8. The hat with a flag according to claim 7 wherein the flag support rod comprises a finial;

wherein the finial is an enlargement of the upper end of the flag support rod such that the upper end of the flag support rod is blunted.

9. The hat with a flag according to claim 7 wherein the flag is a sheet of material that is supported in a vertical orientation by the flag support rod.

10. The hat with a flag according to claim 9 wherein the flag is rigid or semi-rigid such that the flag is held in a position that projects horizontally away from the flag support rod.

11. The hat with a flag according to claim 10 wherein the flag bears an indicia.

12. The hat with a flag according to claim 10 wherein the flag comprises a sleeve;

wherein the sleeve is a casing formed at one side of the flag such that the flag support rod pass through the sleeve;

wherein the flag support rod is coupled to the sleeve such that the flag is held in place at the top of the flag support rod.

13. The hat with a flag according to claim 12 wherein the flag base comprises a lower base, an upper base, and a spring;

wherein the flag base couples to the flag mount to hold the flag support rod in an erect orientation.

14. The hat with a flag according to claim 13 wherein the lower base couples to the flag mount via the threaded shaft that projects downwards from the bottom of the lower base;

wherein an outside wall of the threaded shaft is threaded with a thread that complements the size and thread count of the threaded receiver located on the flag mount.

15. The hat with a flag according to claim 14 wherein the top of the upper base is coupled to a bottom end of the flag support rod.

16. The hat with a flag according to claim 15 wherein the flag support rod couples to the upper base via a bearing such that the flag support rod swivels to redirect the flag.

17. The hat with a flag according to claim 16 wherein the lower base is coupled to the upper base via the spring;

wherein the spring allows the flag base to bend such that the flag support rod is displaced from the vertical orientation by an external force and will return to the vertical orientation when the external force is removed.

18. The hat with a flag according to claim 17 wherein the hat with a flag further comprises the hat;

wherein the hat is a clothing accessory that is adapted to cover a head of a user.

* * * * *